United States Patent [19]

Haskins

[11] Patent Number: 4,730,528

[45] Date of Patent: Mar. 15, 1988

[54] BUTTON COVER CUTTING PRESS APPARATUS

[76] Inventor: Bradley T. Haskins, Rte. 1, Box 119B, Coolidge, Ariz. 85228

[21] Appl. No.: 889,239

[22] Filed: Jul. 25, 1986

[51] Int. Cl.[4] ..... B26D 1/44; B26D 1/04

[52] U.S. Cl. ..... 83/123; 83/128

[58] Field of Search ..... 30/184, 315, 316; 83/123, 124, 125, 127, 128, 145, 588, 633, 634

[56] References Cited

U.S. PATENT DOCUMENTS

| | | | |
|---|---|---|---|
| 78,420 | 6/1868 | Bryan | 83/633 |
| 194,244 | 8/1877 | Jasper | 83/123 |
| 474,243 | 5/1892 | Hallenbeck et al. | 83/123 X |
| 701,974 | 6/1902 | Watson | 83/145 |
| 1,070,854 | 8/1913 | Stoler et al. | 83/128 X |
| 1,151,032 | 8/1915 | Moore | 83/123 |
| 2,452,734 | 11/1948 | Costelow | 30/91.2 |

*Primary Examiner*—E. R. Kazenske
*Assistant Examiner*—Michael D. Folkerts
*Attorney, Agent, or Firm*—H. Gordon Shields

[57] ABSTRACT

Button cover cutting press apparatus includes a frame and a cutter secured to a movable cutting head, and the cutter head and cutter are moved relative to the frame on a central guide rod by means of a lever. The guide rod also acts as an ejector to remove the material cut by the apparatus.

11 Claims, 6 Drawing Figures

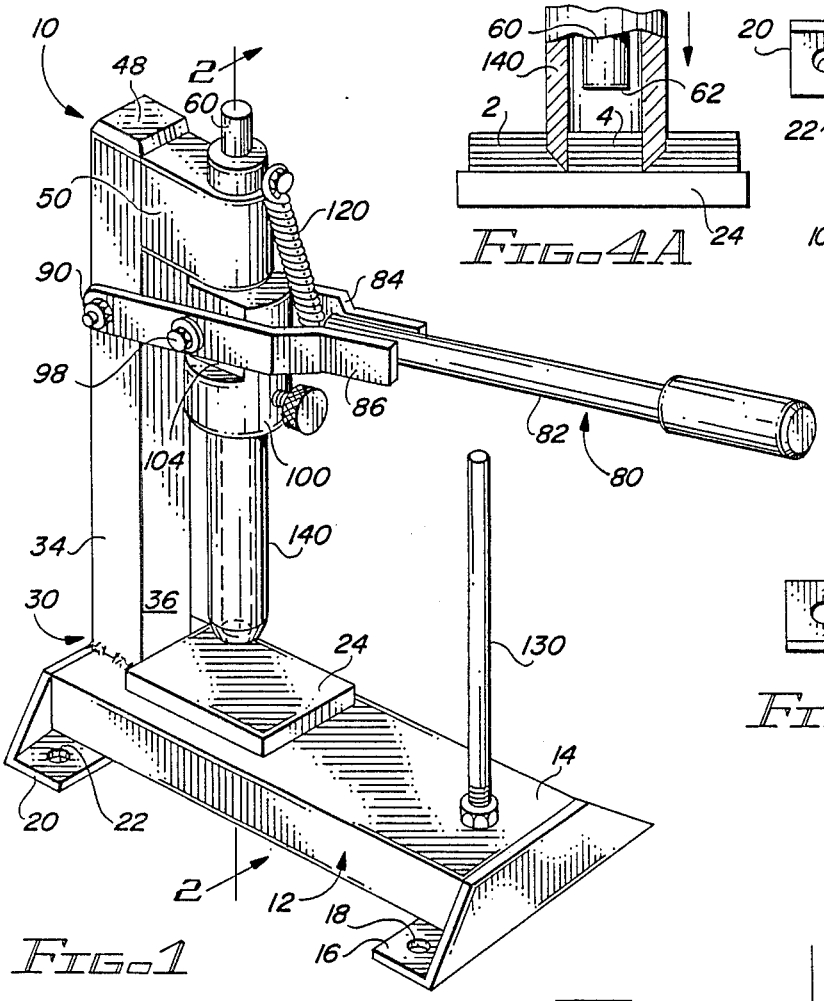
FIG. 1
FIG. 4A
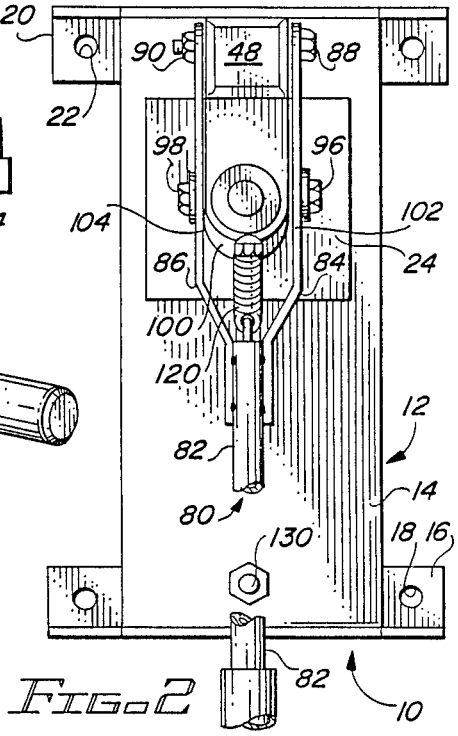
FIG. 2
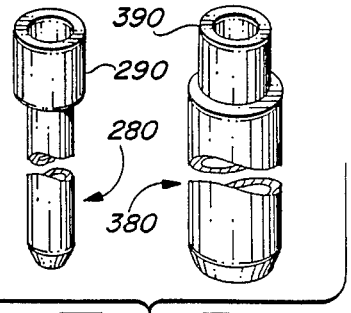
FIG. 5
FIG. 3
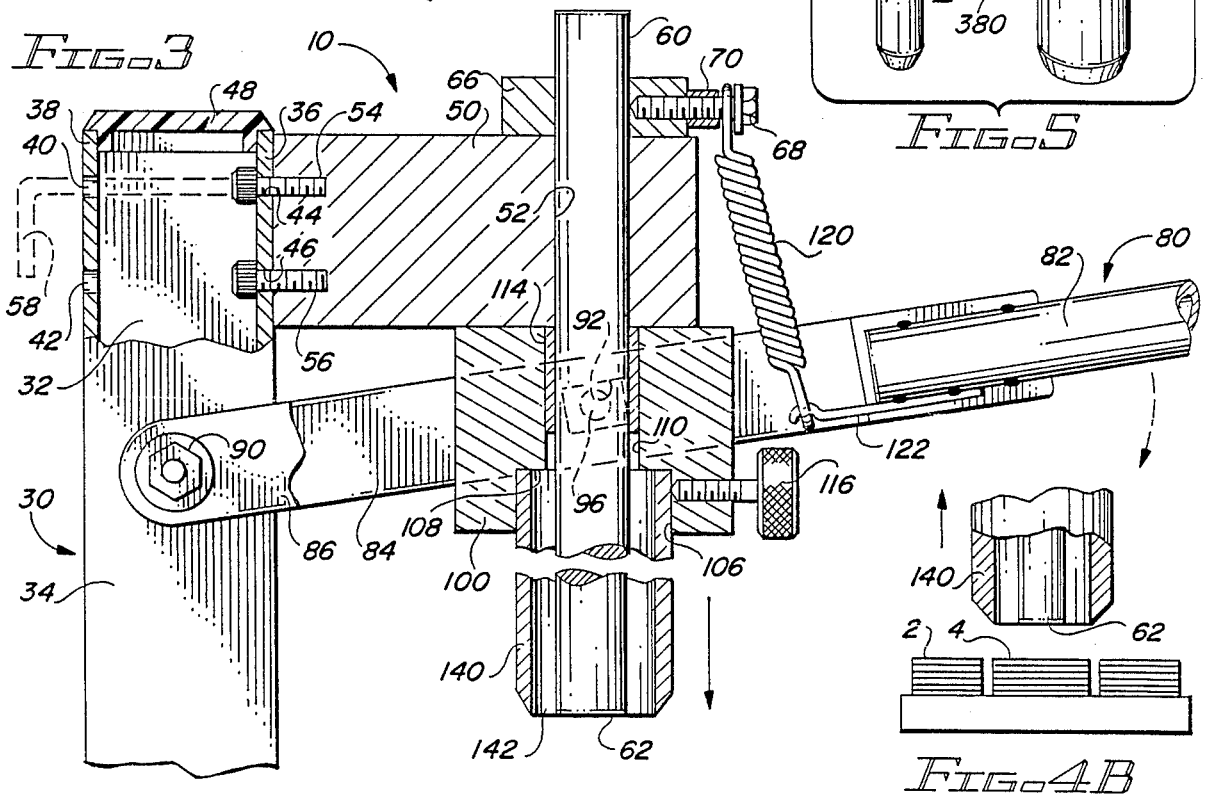
FIG. 4B

BUTTON COVER CUTTING PRESS APPARATUS

BACKGROUND OF THE INVENTION

1. Field of the Invention

This invention relates to cutting apparatus, and more particularly, to cutting apparatus for cutting covers for buttons.

2. Description of the Prior Art

Buttons in the garment and upholstery industries are generally covered with material matching the garment or furniture to which the button will be secured. The buttons are generally in two pieces, including a base piece and a cover or cap piece. The material goes around the cap piece and is pressed onto the base piece to hold the two pieces together, with the edges of the material held together between the two pieces.

The material that is the cover the buttons is made by circular cutter blades. The cutter blades are generally in the configuration of a hollow tube, with a cutting edge at one end of the tube. The cutter is placed on the material to be cut and is forced downwardly so that the blade cuts through the material, which may be one or several layers, by means of the force placed on the top or upper portion of the cutter. In the prior art, the cutting force is usually from a hammer blow or the like.

The prior art method or technique has obvious limitations. Among the limitations are the requirement for a hammer, the requirement for a relatively substantial amount of physical strength, the possibility of damage to the cutter blade, the potential for accident due to mishandling of the cutter, and potential damage to the cutting edge of the cutter due to misalignment of the cutter and/or misalignment of the power stroke by the user.

The apparatus of the present invention overcomes the problems inherent in the prior art by providing a lever-operated cutter in which the cutter moves coaxially along a rod, and the rod acts as a self-ejecting element for ejecting the cut fabric after cutting.

SUMMARY OF THE INVENTION

The invention described and claimed herein comprises a cutting apparatus for cutting material, including a fixed frame and a rod secured to the frame and disposed in the center of a cutter head, and a cutter is secured to the head and is movable downwardly along the rod in response to the pivoting of a handle secured to the fixed frame and the cutter head.

Among the objects of the present invention are the following:

To provide new and useful cutter apparatus;

To provide new and useful apparatus for cutting button covers;

To provide new and useful cutter apparatus having a handle for moving a movable cutter;

To provide new and useful apparatus having a cutter movable on a guide rod;

To provide new and useful cutter apparatus for cutting a plurality of layers of material and having the cut material self-ejected from the cutter; and To provide new and useful cutter apparatus having a handle pivotally secured to a frame and movable to cause a cutter to move in a straight line to cut material.

BRIEF DESCRIPTION OF THE DRAWING

FIG. 1 is a perspective view of the apparatus of the present invention.

FIG. 2 is a top view of the apparatus of the present invention.

FIG. 3 is a side view in partial section through a portion of the apparatus of the present invention.

FIG. 4A is a view in partial section of a portion of the apparatus of the present invention.

FIG. 4B is a sequential view in partial section of the apparatus of FIG. 4A.

FIG. 5 is a broken perspective view of alternate embodiments of cutter elements usable with the apparatus of the present invention.

DESCRIPTION OF THE PREFERRED EMBODIMENT

FIG. 1 is a perspective view of button cover cutting press apparatus 10 of the present invention. FIG. 2 is a top view of the button cover cutting press apparatus 10 of FIG. 1. FIG. 3 is a side view in partial section through the upper portion of the button cover cutting press apparatus 10 of the present invention. For the following discussion, reference will be made to FIGS. 1, 2, and 3.

As shown in FIGS. 1 and 2, the button cover cutting press apparatus 10 includes a base 12. The base 12 includes a center channel portion 14 secured to and extending between a pair of end brackets 16 and 20. The end brackets extend outwardly beyond the sides of the center channel portion 14. The end bracket 16 includes a pair of apertures 18 extending through the bracket. The bracket 20 similarly includes a pair of apertures 22 extending through the bracket. The apertures 18 and 22 may be used to appropriately secure the apparatus 10 to a workbench, etc., by appropriate fastening elements such as bolts (not shown). A pad 24 is appropriately secured to the top of the channel 14.

Extending upwardly from one end of the channel 14, and adjacent to the end bracket 20, is a post 30. The post 30 may preferably simply be a length of square tubing, having four webs. The webs include a pair of side webs 32 and 34, which are substantially parallel to each other, and a pair of end webs 36 and 38, which are also substantially parallel to each other. The web 38 is shown in FIG. 3 as including a pair of spaced apart apertures 40 and 42 extending through the web. The apertures 40 and 42 are appropriately aligned with another pair of apertures 44 and 46 which extend through the web 36. A cap 48 is disposed on the top of the post 30.

A block 50 is secured to the upper portion of the post 30 by a pair of screws 54 and 56 which extend through the apertures 44 and 46, respectively, in the web 36. In FIG. 3, an Allen wrench 58 is shown in phantom extending through the aperture 40 and into the Allen head cap screw 54. The Allen wrench 58 is appropriately used to secure the screw 54 to the block 50 and to the web 36 of the post 30. Similarly, the wrench 58 may extend through the aperture 42 to be used with the screw 56.

The block 50 includes a vertically oriented bore 52 which extends through the block 50. A guide and ejector rod 60 extends through the bore 52. The rod 60 includes a bottom 62. The guide and ejector rod 60 is secured to the block 50 by means of a screw 68. The screw 68 extends through a tapped hole in a collar 66. The collar 66 is disposed about the rod 60 on top of the block 50. The tapped hole is radially extending through the collar 66 and communicates directly with a center bore in the collar through which the rod 60 extends.

A sleeve 70 is disposed about the shank of the screw 68 outwardly from the collar 66. The purpose of the sleeve 70 will be discussed below.

A handle assembly 80 is pivotally secured to the post 30. The handle assembly 80 includes an outer rod 82 secured to a pair of yoke arms 84 and 86. The rod 82 is preferably secured as by welding to the yoke arms 84 and 86. The yoke arms 84 and 86 are appropriately pivotally secured to the webs 32 and 34, respectively, by a bolt 88 and a nut 90. The bolt 88 extends through aligned apertures in the yoke arms 84 and 86 and through aligned apertures in the webs 32 and 34.

The handle assembly 80, again through the yoke arms 84 and 86, is also appropriately secured to a cutter head assembly 100. The cutter head assembly 100 is a generally cylindrical element having a pair of axially extending relieved portions 102 and 104 on the outer periphery of the cutter head, and having a lower central bore 106 and an upper central bore 110. The bores 106 and 110 are coaxial. A radially extending shoulder 108 is disposed between the upper end of the bore 106 and the lower end of the bore 110.

The yoke arms 84 and 86 of the handle assembly 80 are secured to the cutter head 100 by a pair of screws 96 and 98, respectively. This is shown best in FIGS. 1 and 2. The yoke arms 84 and 86 extend along the relieved portions 102 and 104, respectively, and the screws 96 and 98 in turn extend inwardly into appropriately tapped apertures in the cutter head 100 from the relieved portions to secure the yoke arms to the cutter head.

The screws 96 and 98 extend through a pair of slots in the yoke arms. A slot 92 in the yoke arm 84 is shown in phantom in FIG. 3. The slots in the yoke arms extend generally horizontally. The purpose of the slots is to provide for the pivoting movement of the handle assembly 80 and, at the same time, to provide for the linear movement of the cutter head 100.

A bushing 114 is pressfitted into the upper portion of the upper bore 110 of the cutter head 100. The bushing 114 includes a central bore through which the rod 60 extends. It will be noted that the bushing 114 is the only movable part of the apparatus 10 which contacts the rod 60. That is, the bushing 114 moves linearly on the rod 60 in response to the pivoting movement of the handle assembly 80 and of the vertically linear movement of the cutter head 100.

A tension spring 120 extends between the sleeve 70 on the screw 68 and a spring retainer 122, which is appropriately secured, as by welding, to the rod 82 of the handle assembly 80. The tension spring 120 comprises a return spring for returning the handle assembly 80 and the cutter head 100 upwardly after a downward cutting stroke. The sleeve 70 is the upper, fixed anchor for the spring 120 and keeps the spring away from the collar 66 and the block 50.

To limit the downward movement of the handle assembly 80 and the cutter head 10, an adjustable stop rod 130 is used. The stop rod 130 extends upwardly from the channel 14 of the base 12. Downward movement of the rod 82 of the handle 80 is limited by the height of the stop rod 130, or by the height of the stop rod 130 relative to the top surface of the pad 24.

A cutter 140 is also appropriately secured to the bore 106 of the cutter head 100. The top of the cutter 140 is illustrated in FIG. 3 as being disposed at the shoulder 108 and downwardly from the bottom of the bushing 114. The cutter 140 is secured to the cutter head 100 by a thumb screw or set screw 116. The thumb screw or set screw 116 retains the cutter 140 in the bore 106. The pad 24 is disposed beneath the cutter 140.

At the bottom of the cutter 140 is a blade or cutting edge 142. As shown in FIG. 3, the bottom 62 of the rod 60 is at the same height as the blade or edge 142 of the cutter 140. The rod 60, being fixed, does not move downwardly during the cutting stroke. However, on the up or return stroke of the handle and the cutter head and cutter, the rod 62 acts as an ejector to eject material cut during the cutting stroke. It will be understood that, during the cutting stroke, material cut will tend to move upwardly within the cutter 140. The greater the thickness of the layer or layers of material cut during the cutting stroke, the farther within the cutter 140 the cut material will extend. The upward movement of the cutter, with the rod 60 remaining fixed, will cause the material to be ejected from within the cutter 140.

In FIGS. 4A and 4B, the ejection of cut material from within the cutter 140 by the bottom 62 of the rod 60 is shown. FIGS. 4A and 4B are sequential views in partial section of part of the cutter head and the rod 60 during the cutting stroke and the following return stroke, respectively.

In FIG. 4A, the cutter 140 is shown disposed on the pad 24 at the end of its downward cutting stroke. The cutter 140 has cut through several layers of material 2 disposed on the pad 24. Cut button covers 4 are shown extending upwardly within the interior bore of the cutter 140.

In FIG. 4B, the cutter 140 is shown in its up position or at the end of its return stroke following the downward cutting stroke. The bottom of the cutter 140 is again positioned adjacent to the bottom 62 of the rod 60. As the cutter 140 moves upwardly, the cut botton covers 4 move upwardly until the bottom 62 of the rod contacts them and pushes (ejects) them downwardly and out of the cutter 140 as the cutter moves relative to the rod.

It will be understood that the cutters come in different sizes, depending on the size button for which the material cut by the apparatus 10 will be used. It will also be noted that the cutters comprise cylindrical elements with a bottom cutting edge. The apparatus of the present invention may be used with different sizes of cutters, that is, different diameters of cylindrical cutter elements, by simply changing heads.

The cutter 140 is removed from the head 100 by loosening the thumb screw or set screw 108, and by removing the cylindrical cutter 140 from the bore 106. Next, the screws 96 and 98 are removed so that the yoke arms 84 and 86 of the handle 80 may be removed from the head 100. Next, the tension spring 120 is removed from the sleeve 70 of the screw 68. The screw 68 is then released to allow the rod 60 to move upwardly relative to the block 50 and the head 100. At such time as there is sufficient clearance between the bottom 62 of the rod 60 and the pad 24, the head 100 may be removed from the apparatus.

Next, a new head, with a bore having the desired inside diameter to mate with the cylindrical cutter having the desired outer diameter, is secured in the reverse manner to that described in removing the head 100. Obviously, the inside diameter of the bushing 114 will remain the same because the rod 60 remains in place.

After the new head is inserted in place, the screws 96 and 98 are replaced. Now, the apparatus 10 is ready to receive a new cutter.

After the new cutter is inserted, the rod 60 is adjusted to the desired height with respect to the bottom of the cutter. The screw 68 is then secured to the collar 66 to secure the rod 60 to the collar 66 and in place relative to the block 50. The tension spring 120 is then replaced to bias the handle assembly 80 and the head 100 upwardly against the block 50.

In the alternative to matching heads to cutters, and thus to replacing a head each time a cutter is replaced, a single cutter head 100 may be utilized with different-sized cutter sleeves, as shown in FIG. 5. FIG. 5 is a perspective view of a pair of cutter elements 280 and 380. The cutter element 280 has a diameter substantially less than the diameter of the cutter 140, and the cutter 380 has an outer diameter substantially greater than the outer diameter of the cutter 140.

For the cutter 280, a sleeve 290 is pressfitted onto the upper portion of the cutter 280. Or, put another way, the upper portion of the cutter 280 is pressfitted into the sleeve 290. The outer diameter of the sleeve 290 is substantially the same as the outer diameter of the cutter 140, and the sleeve 290 accordingly fits into the bore 106 of the head 100. The set screw 116 bears against the sleeve 290 to hold the sleeve 290 and the cutter 280 in the head 100.

For the cutter 380, a sleeve 390 is inserted into the upper portion of the interior bore of the cutter 380. The outer diameter of the sleeve 390 is substantially the same as the inner diameter of the bore 106, and the sleeve 390 accordingly extends into the bore 106 to secure the cutter 380 to the head 100. Again, the set screw 116 is used to hold the sleeve 390, and the cutter 380, to the head 100 and to the cutter press apparatus 10. Obviously, the cutter 380 and the sleeve 390 are appropriately secured together.

By utilizing the sleeves 290 and 390, a single head 100 may be used for cutters of virtually all diameters. Typically, there are primarily three different sized cutters which are used in the majority of the cases. It is accordingly not difficult to configure either sleeves or different bore diameter heads for the cutters, as desired.

While the principles of the invention have been made clear in illustrative embodiments, there will be immediately obvious to those skilled in the art many modifications of structure, arrangements, proportions, the elements, materials, and components used in the practice of the invention, and otherwise, which are particularly adapted for specific environments and operative requirements without departing from those principles. The appended claims are intended to cover and embrace any and all such modifications, within the limits only of the true spirit and scope of the invention. This specification and the appended claims have been prepared in accordance with the applicable patent laws and the rules promulgated under the authority thereof.

What I claim is:

1. Cutter press apparatus for cutting material, comprising, in combination:

base means;

post means secured to the base means and extending upwardly therefrom;

block means secured to the post means remote from the base means;

rod means secured to the block means, including a rod having a bottom end;

head means movable on the rod of the rod means from an upper position to a lower cutting position;

cutter means secured to and movable with the head means and including a cutter blade disposed adjacent to the bottom end of the rod when the head is in the upper position; and handle means pivotally secured to the post means between the base means and the block means and to the head means for moving the head means and the cutter means from the upper position to the lower cutting position for cutting material disposed on the base means and for moving the head means and the cutter means from the lower cutting position to the upper position whereby any cut material retained by the cutter means is ejected by the bottom of the rod as the cutter moves upwardly to the upper position in which the cutter blade is disposed adjacent to the bottom of the rod.

2. The apparatus of claim 1 in which the head means includes bushing means movable on the rod of the rod means as the head means moves.

3. The apparatus of claim 1 in which the base means includes a pad, and material to be cut is disposed on the pad.

4. The apparatus of claim 1 in which the block means includes a block secured to the post means, and a bore in the block through which the rod extends.

5. The apparatus of claim 4 in which the rod means further includes a collar disposed on the block through which the rod extends, and a screw for securing the collar to the rod.

6. The apparatus of claim 1 in which the handle means includes spring means for biasing the head means and the cutter means to the upper position.

7. The apparatus of claim 6 in which the handle means further includes a yoke having a first arm and a second arm, both of which are secured to the post means and to the head means, and an outer rod secured to the first and second arms remote from the post means, and movement of the outer rod pivots the first and second arms and moves the head means and the cutter means on the rod of the rod means.

8. The apparatus of claim 6 in which the spring means includes a tension spring secured to and extending between the rod of the handle means and the collar of the rod means.

9. The apparatus of claim 8 in which the spring means further includes a spring retainer secured to the outer rod, and the tension spring is secured to the spring retainer.

10. The apparatus of claim 1 in which the base means further includes stop means for determining the lower cutting position of the head means and the cutter means as the handle means contacts the stop means.

11. The apparatus of claim 1 in which the rod means includes a rod vertically adjustable relative to the block means.

* * * * *